US006519853B1

(12) United States Patent
Machida et al.

(10) Patent No.: US 6,519,853 B1
(45) Date of Patent: Feb. 18, 2003

(54) METHOD OF MANUFACTURING HAND FOR ANALOG ELECTRONIC TIMEPIECE

(75) Inventors: Takayasu Machida, Iruma (JP); Takanori Nanya, Sayama (JP); Shigeyuki Takahashi, Kodaira (JP); Kazuo Suzuki, Tokorozawa (JP); Takeaki Shimanouchi, Hannou (JP)

(73) Assignee: Citizen Watch Co., Ltd., Tokyo (JP)

( * ) Notice: Subject to any disclaimer, the term of this patent is extended or adjusted under 35 U.S.C. 154(b) by 0 days.

(21) Appl. No.: 09/720,748

(22) PCT Filed: Jul. 2, 1999

(86) PCT No.: PCT/JP99/03598

§ 371 (c)(1),
(2), (4) Date: Dec. 29, 2000

(87) PCT Pub. No.: WO00/02100

PCT Pub. Date: Jan. 13, 2000

(30) Foreign Application Priority Data

Jul. 3, 1998 (JP) ..... 10-188415

(51) Int. Cl.[7] ..... G04D 3/00
(52) U.S. Cl. ..... 29/896.3; 72/203; 368/238
(58) Field of Search ..... 29/896.3–896.34; 72/185, 203, 334, 379.2; 368/238

(56) References Cited

U.S. PATENT DOCUMENTS 3,776,012 A * 12/1973 Berg et al. ..... 72/203

FOREIGN PATENT DOCUMENTS

| | | |
|---|---|---|
| JP | 57-52544 | 3/1982 |
| JP | 58-140484 | 9/1983 |
| JP | 61-50213 | 4/1986 |
| JP | 62-20390 | 2/1987 |

* cited by examiner

*Primary Examiner*—P. W. Echols
(74) *Attorney, Agent, or Firm*—Armstrong, Westerman & Hattori, LLP

(57) ABSTRACT

A pair of parallel rectangular windows are punched out in a thin sheet base material having the same thickness as that of a short hand part (13) including a weight part (13*a*) of a second hand (10) so as to form a hand forming part between the pair of windows and a part in the hand forming part forming a long hand part and a mounting part of a hand is pressed so as to form a thin wall part. Then, the second hand in a final shape is punched out from the base material so that a long hand part (11) and a mounting part (12) are formed with the thin wall part of the hand forming part and the short hand part (13) is formed with an original thickness part. Consequently, the second hand for an analog electronic timepiece in which the weight part (13*a*) is provided on the short hand part (13) can be easily and securely manufactured only by a press working.

5 Claims, 7 Drawing Sheets

METHOD OF MANUFACTURING HAND FOR ANALOG ELECTRONIC TIMEPIECE

TECHNICAL FIELD

The present invention relates to a method of manufacturing a hand for an analog electronic timepiece, that is, a hand (especially, a second hand) for an analog electronic timepiece in which a long hand part for indicating time, a mounting part to be mounted to a hand shaft, and a short hand part extending to the opposite side to the long hand part with respect to the mounting part are integrally formed, and a weight part is provided on the short hand part.

BACKGROUND TECHNOLOGY

First, the basic structure of a three-hand analog electronic timepiece will be explained with FIG. 7. In a typical three-hand analog electronic timepiece, torque generated by a step motor 60 composed of a rotor 60*a*, a stator 60*b*, and a coil 60*c* is transmitted from the rotor 60*a* to a fifth wheel 61, a second wheel 62, a third wheel 63, a center wheel 64 until an hour wheel 66 in order through pinions 71 to 75 and a minute wheel not shown respectively with being reduced to a predetermined rotation speed.

Further, a second hand 69, a minute hand 68, and an hour hand 67 are mounted on the second wheel 62, the center wheel 64, and the hour wheel 66 respectively to fit thereon through coaxial hand shafts respectively, so that time is indicated by the hands. It should be noted that the second hand 69, the minute hand 68, and the hour hand 67 are collectively called the hands. Incidentally, numeral 51 denotes a main plate, and numeral 52 denotes a train wheel bridge.

While the hands are standing still, each of the hands is held by the holding energy possessed by the step motor 60 to prevent a hand-skip phenomenon from occurring on receiving an external impact.

On the other hand, while the hands are moving, the step motor 60 generates driving energy which exceeds the holding energy so as to drive the hands.

FIG. 8 is a perspective view showing an example of the shape of a conventional typical second hand. This second hand 69 is composed of a long hand part 69*a* for indicating time, a mounting part 69*b* to be mounted to a second hand shaft, and a short hand part 69*c* extending to the opposite side to the long hand part 69*a* with respect to the mounting part 69*b*, and these parts are normally made of the same material into the same thickness.

A cylindrical fitting member 50 is firmly secured to the mounting part 69*b*, and the fitting member 50 fits over the second hand shaft 62*a* which is provided integrally with the second wheel 62, whereby the second hand 69 is mounted to the second wheel 62. Thus, the long hand part 69*a* indicates time (second). The minute hand 68 and the hour hand 67 are the same in basic shape.

Incidentally, an inconvenience of replacement of batteries once per several years is pointed out in a recent electronic timepiece, and it is desired that replacement of batteries is made unnecessary. As a measure to that, increase in capacity of a battery and reduction in power consumption are considered, but upsizing of the battery for increasing the capacity thereof can not be expected because of limitation in size of a wristwatch. Furthermore, the reduction in power consumption already comes to a limit though improvements in electromechanical conversion efficiency of the step motor have been made mainly by reducing the size of a magnet through enhancement of the power thereof or by optimizing a driving wave form or the like, and therefore more drastic reduction in power consumption can not be expected through the use of conventional methods.

Moreover, in the analog electronic timepiece, holding energy for holding the hands is generally required in order to prevent a hand-skip phenomenon caused by rotational energy, disturbance energy, generated by an external impact received during the standing still. As the holding energy, holding energy called magnetic potential (resistance force against moving from a still point) possessed by the step motor is normally used, which needs to be set at a value larger than a value of the disturbance energy generated by the external impact.

The magnitude of the disturbance energy, to which the moment of a rotating body composed of each hand, and the gear, pinion, and shaft to which the hand is mounted is related, is generally determined by the moment of the long hand part and the short hand part of the hand in relation to the rotational axis.

However, in a typical second hand used in the conventional analog electronic timepiece, since the long hand part 69*a* and the short hand part 69*c* are the same in thickness and different in length as is clear from FIG. 8, the moments of both parts with respect to a rotational axis line 70 are apparently unbalanced. Therefore, the second hand has some moment, resulting in occurrence of disturbance energy by an external impact.

The longer the long hand part becomes as the hand becomes larger as especially in a wristwatch for men, the greater the moment becomes, and separately the moment becomes larger in a designed hand which is designed differently in shape from a viewpoint of decoration, resulting in increased disturbance energy.

On the other hand, during driving the hand, the step motor generates driving energy exceeding the holding energy value which is set to be larger than the disturbance energy value so as to drive the hand.

The driving energy value here is a resultant value obtained by subtracting the holding energy value from a value of the whole energy generated by the step motor. In other words, the driving energy value is a value of effective energy, which rotationally moves the hand only a fixed angle in a predetermined period of time, beyond the value of the holding energy possessed by the step motor.

Therefore, it is apparent that if the holding energy value is decreased, energy which is consumed to exceed the holding energy value decreases and the whole energy required to drive the hand also decreases. In other words, it can be said that decreasing the holding energy value is effective to reduce power consumption.

As described above, however, the holding energy value can not be made small enough from the viewpoint of holding hand. Conversely, when low power consumption is achieved by decreasing the holding value, there is a problem that the disturbance energy value is larger than the holding energy value, whereby the hand can not be held adequately though the hand can move, bringing about a hand-skip phenomenon.

Hence, it is proposed that, for example, a weight is added to the short hand part 69*c* of the second hand 69 shown in FIG. 8 to reduce imbalance between the moments of the long hand part 69*a* and the short hand part 69*c* with respect to the rotational axis line 70 so as to decrease the disturbance energy value. This can also decrease the holding energy value, whereby the energy, which is consumed for the driving energy by the step motor to exceed the holding energy during the driving of the hand, is also decreased, making it possible to reduce the power consumption.

In order to manufacture the hand to which the weight is added as above, the whole hand has been conventionally formed by being punched out from a metal thin sheet material with a uniform thickness, and thereafter a small weight is bonded to an under face of the short hand part with an adhesive.

However, workability of the work of bonding the weight to the short hand part of a small hand such as a second hand of a wristwatch is poor, and thus it takes a great deal of time. Further, the weight is susceptible to being detached from the hand in use for a long time if the bonding is inadequate.

DISCLOSURE OF THE INVENTION

This invention is made to solve the above-described problems, and its object is to make it possible to manufacture easily and securely a hand for an analog electronic timepiece in which a weight part is provided on a short hand part and also to eliminate the danger for the weight to be detached from the hand.

To attain the above objects, the invention proposes the following first to third manufacturing methods as a method of manufacturing a hand for an analog electronic timepiece in which a long hand part for indicating time, a mounting part to be mounted to a hand shaft, and a short hand part extending to the opposite side to the long hand part with respect to the mounting part are integrally formed and a weight part is provided on the short hand part.

In the first manufacturing method according to the invention, the following first and second steps are performed in order:

a first step of making a part in a hand forming part forming the long hand part and the mounting part of the hand thinner in thickness to form a thin wall part in a thin sheet base material including the hand forming part; and a second step of punching out the hand in a final shape from the base material to form the long hand part and the mounting part with the thin wall part of the hand forming part and the short hand part with a part except for the thin wall part, respectively, wherein in the first step, it is preferable that the thin wall part is formed by press working.

In this case, if before the first step, a step of punching out a pair of parallel rectangular windows on both sides of the hand forming part of the base material is performed, the windows becomes places to which the material escapes when the thin wall part is formed by press working, facilitating the press working.

Further, in the first step, it is also suitable that the thin wall part is formed by press working at the part forming the long hand part and the mounting part of the hand in the hand forming part of the base material, and a thick wall part which is thicker than the original thickness is formed by coining at the part adjacent to the thin wall part forming the short hand part, respectively. In that case, in the second step, the hand in a final shape is punched out to form the long hand part and the mounting part with the thin wall part of the hand forming part and the short hand part with the thick wall part, respectively.

Incidentally, it is preferable that a plate material of brass or aluminum is used as the base material.

In the second manufacturing method according to the invention, the following first to third steps are performed in order:

a first step of punching out a window in a thin sheet base material having the same thickness as that of the long hand part and the mounting part of the hand to surround three sides of the weight part of the short hand part;

a second step of bending up the part of the base material forming the weight part and folding it to overlap on the part forming the short hand part; and a third step of punching out the hand in a final shape from the base material to form the long hand part and the mounting part with the part forming the long hand part and the mounting part and the short hand part with the part forming the short hand part on which the part forming the weight part is overlapped, respectively.

In this case, following the first step, a step of overlapping a plate-shaped piece on a region including the part forming the short hand part of the hand on the base material except for the part forming the long hand part and the mounting part of the hand and the part forming the weight part is further performed, and in the second step, the part forming the weight part of the base material is folded to overlap on the part forming the short hand part with the plate-shaped piece interposed therebetween.

Further, it is preferable that a plate-shaped piece having the same width as that of the base material is used as the plate-shaped piece, and a window which corresponds to the part forming the weight part of the base material and the window surrounding the three sides thereof is formed in the plate-shaped piece in advance.

If a plate material with a density higher than that of the base material is used as the plate-shaped piece, a weight part with a great mass can be formed even with a small short hand part.

It is preferable that, for example, a plate material of brass or aluminum is used as the base material, and a plate material of tantalum is used as the plate-shaped piece.

In the third manufacturing method according to the invention, the following first and second steps are performed in order:

a first step of joining a weight forming member to a part of the surface of a thin sheet base material having the same thickness as that of the long hand part and the mounting part of the hand; and a second step of punching out the hand in a final shape from the base material to form the long hand part and the mounting part of the hand with a part to which the weight forming member is not joined and the short hand part provided with the weight part with the part to which the weight forming member is joined, respectively.

If a material with a density higher than that of the base material is used as the weight forming member, a weight part with a great mass can be formed even with a small short hand part.

It is preferable that, for example, a plate material of brass or aluminum is used as the base material, and a tantalum material is used as the weight forming member.

BEST MODE FOR CARRYING OUT THE INVENTION

Hereinafter, embodiments of a method of manufacturing a hand for an analog electronic timepiece according to the invention will be described in detail with reference to the drawings.

Figure 1:
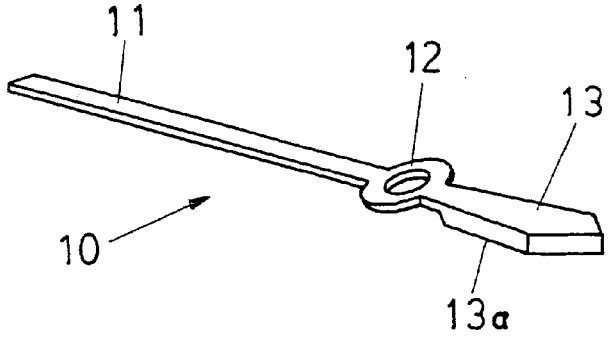
FIG. 1 is a perspective view of a second hand for an analog electronic timepiece manufactured by a first manufacturing method according to the invention.
Figure 2:
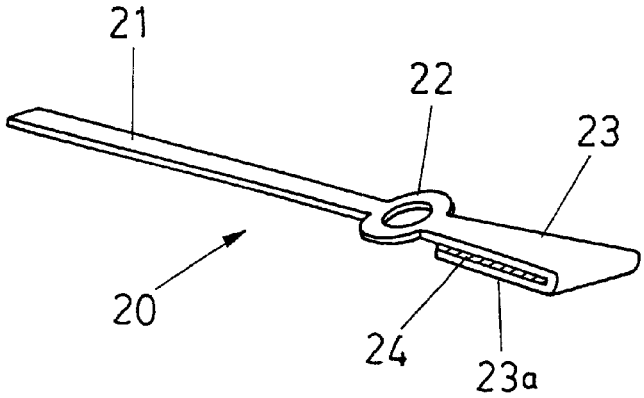
FIG. 2 is a perspective view of a second hand for an analog electronic timepiece manufactured by a second manufacturing method according to the invention.
Figure 3:
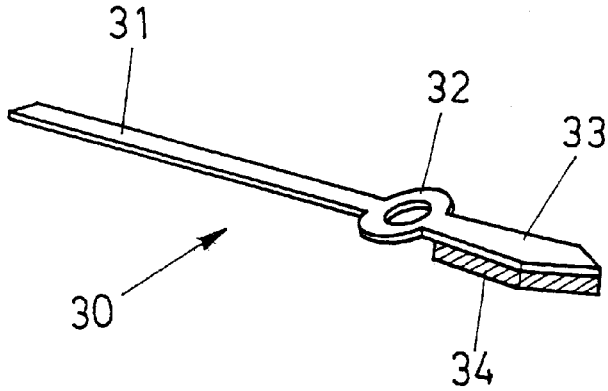
FIG. 3 is a perspective view of a second hand for an analog electronic timepiece manufactured by a third manufacturing method according to the invention.

Prior to the description, examples of the shapes of hands, second hands for analog electronic timepieces here, manufactured by methods of manufacturing hands for analog electronic timepieces according to the invention will be shown here in FIG. 1 to FIG. 3.

FIG. 1 is a perspective view of a hand for an analog electronic timepiece manufactured by a first manufacturing method as described later.

In a second hand 10, a long hand part 11 for indicating time, an annular mounting part 12 to be mounted to a hand shaft, and a short hand part 13 extending to the opposite side to the long hand part 11 with respect to the mounting part 12 are integrally formed, and a thick wall weight part 13*a* is integrally formed on a rear face side (on a dial side) of the short hand part 13.

FIG. 2 is a perspective view of a hand for an analog electronic timepiece manufactured by a second manufacturing method as described later.

In a second hand 20, a long hand part 21 for indicating time, an annular mounting part 22 to be mounted to a hand shaft, and a short hand part 23 extending to the opposite side to the long hand part 21 with respect to the mounting part 22 are integrally formed, and a folded-back part 23*a* is provided on the short hand part 23 to thereby interpose a weight member 24 to form a weight part. It is also suitable, however, that the folded-back part 23*a* directly overlaps on the short hand part 23 without providing the weight member 24.

FIG. 3 is a perspective view of a hand for an analog electronic timepiece manufactured by a third manufacturing method as described later.

In a second hand 30, a long hand part 31 for indicating time, an annular mounting part 32 to be mounted to a hand shaft, and a short hand part 33 extending to the opposite side to the long hand part 31 with respect to the mounting part 32 are integrally formed, and a weight part 34 made of another member is integrally provided on a lower face of the short hand part 33.

Here, operational sequency and effects by virtue of the above-described provision of the weight part on the short hand part of the hand for the analog electronic timepiece will be explained.

The inventors found a method which can further reduce power consumption by decreasing holding energy possessed by a step motor while keeping hand-holding upon an external impact in an analog electronic timepiece.

The relation between a rotor equivalent inertial moment of the step motor as the whole structure of a rotating mechanism for rotating the hand and inertial moments of respective components is expressed by the following mathematical expression (1).

$$J \approx Jr + J5/36 + (J4 + Js)/900 \quad (1)$$

Assuming a three-hand analog electronic timepiece, "J" represents a rotor equivalent inertial moment of the whole rotating mechanism, and "Jr", "J5", "J4", and "Js" represent inertial moments of a rotor, a fifth wheel, a second wheel, and the hand respectively. This points to the fact that the smaller the rotor equivalent inertial moment "J" as the whole rotating mechanism is, the smaller the driving energy becomes.

Further, disturbance energy value means a value of rotational energy that occurs at a rotating body composed of the hand and the gear, pinion, and shaft fitting with the hand upon receiving an external impact, and the mechanism of occurrence thereof is considered to derive the following mathematical expression (2).

$$E = (v^2/2) \times (M^2/I) \quad (2)$$

In the above expression, "E" represents the value of disturbance energy which occurs at the rotating body upon an external impact, "v" represents a speed of the timepiece when it performs translation motion by receiving the external impact, "M" represents a moment possessed by the rotating body, and "I" represents a hand equivalent inertial moment, which represents an equivalent inertial moment of the whole rotating body including train wheels for transmitting torque between the hand and the rotor of the step motor viewed from the hand and is expressed by the following mathematical expression (3).

$$I = J4 + Js + 25 \times J5 + 900 \times Jr \quad (3)$$

Decreasing "M" in the above mathematical expression (2), that is, the moment of the hand as the moment of the rotating body, is effective for decreasing the disturbance energy value. Further, it was shown that a hand-skip phenomenon can be prevented in a range where $Ep > (v^2/2) \times (M^2/I)$ is satisfied from the mathematical expressions (2) and (3), which matches with the actual hammer test results. Here, "Ep" represents a holding energy value.

A weight part is provided on the short hand part of each of the second hands 10, 20, and 30 shown in FIG. 1 to FIG. 3 to thereby reduce the moment of the whole second hand and further to reduce the moment of the whole rotating mechanism.

First Embodiment

A first embodiment of the method of manufacturing a hand for an analog electronic timepiece according to the invention will be explained using FIG. 4A to FIG. 4D. This embodiment is the method of manufacturing the second hand 10 shown in FIG. 1.

Figure 4A:
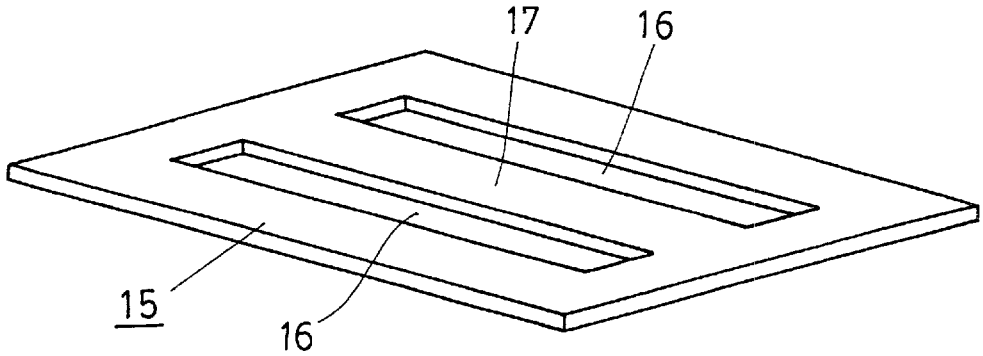
FIG. 4A to FIG. 4D are perspective views showing steps of the first manufacturing method according to the invention.

First, a pair of parallel rectangular windows 16, 16 are formed on both sides of a hand forming part 17 as shown in FIG. 4A by being punched out in a thin sheet base material 15 having the same thickness as that of the short hand part 13 including the weight part 13*a* of a completed product of the second hand 10 shown in FIG. 1.

Figure 4B:
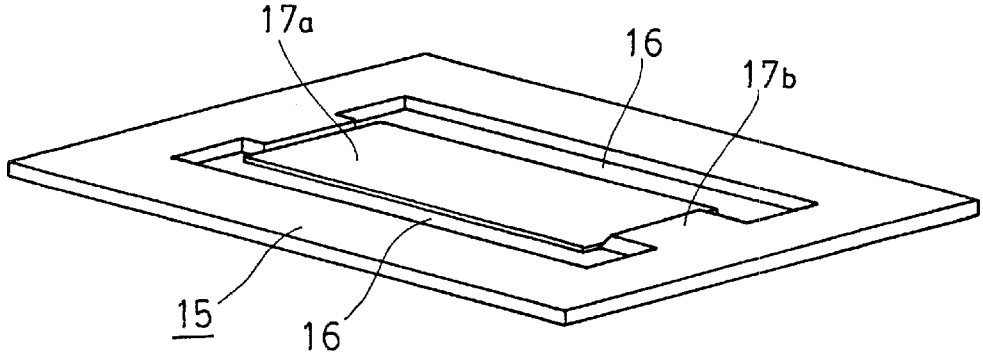

Next, as shown in FIG. 4B, a thin wall part 17*a* is formed by pressing a part within the hand forming part 17 of the base material 15 for forming the long hand part 11 and the mounting part 12 of the second hand 10 to make it the same thickness as that of the long hand part 11 and the mounting part 12 of the completed product (First step). At this time, the existence of the windows 16, 16 facilitates working since excess material of the pressed hand forming part 17 escapes thereto.

Figure 4C:
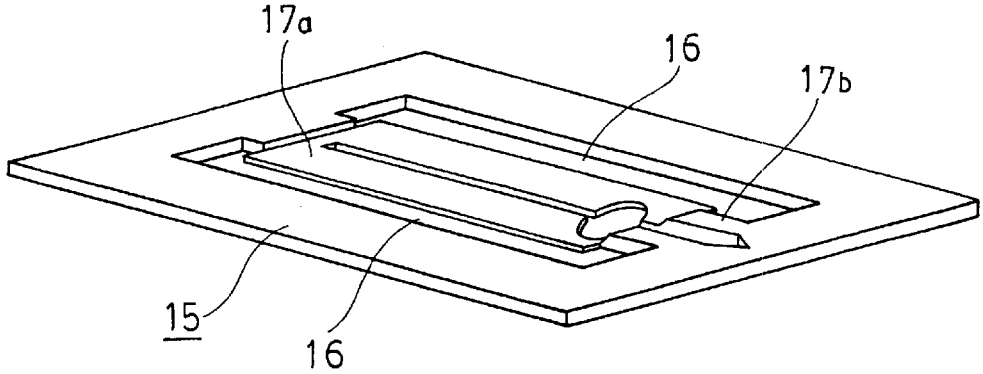
Figure 4D:
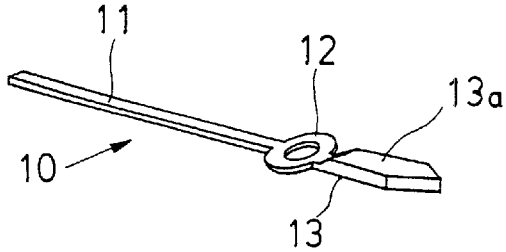

Then, the second hand 10 in the final shape is punched out from the base material 15 as shown in FIG. 4C and FIG. 4D so that the long hand part 11 and the mounting part 12 of the second hand 10 are formed with the thin wall part 17*a* of the hand forming part 17 and the short hand part 13 is formed with an original thickness part 17*b,* respectively (Second step).

Therefore, the short hand part 13 of the completed second hand 10 shown in FIG. 4D is thicker in wall thickness than the long hand part 11 and the mounting part 12, in which a margin in thickness is added as the weight part 13*a*.

As described above, the second hand 10 can be completed only by press process according to this embodiment. Incidentally, a plate material of brass with a thickness of 0.39 mm was used as the base material 15, and the long hand part 11 and the mounting part 12 of the second hand 10 were made 0.13 mm in thickness and the short hand part 13 including the weight part 13*a* was made to have a thickness of 0.39 mm which is the original thickness of the base material 15 in this embodiment. As a result, the moment of the second hand was reduced to 67% of the conventional one.

In this embodiment, however, even if the step of forming the pair of the windows 16, 16 by punching them out on both sides of the hand forming part 17 in the base material 15 is omitted, the thin wall part 17*a* can easily be formed in the base material 15 in the case where the quality of the base material 15 is good in malleability or with raised pressure in press working in the first step.

Further, the thin wall part 17*a* is formed not only by press working in the first step, but it can be formed also by cut working.

Furthermore, it is possible to form the thin wall part 17*a* by press working at a part of the hand forming part 17 in the base material 15 for forming the long hand part and the mounting part of the hand and additionally to form a thick wall part which is thicker than the original thickness by coining with the excess material of the thin wall part 17*a* at the part 17*b* adjacent to the thin wall part 17*a* for forming the short hand part in the first step.

In that case, the hand is punched out in the final shape so that the long hand part and the mounting part are formed with the thin wall part 17*a* of the hand forming part 17 and the short hand part is formed with the thick wall part respectively in the second step.

In the case of this method, a plate material with a thickness intermediate between the thickness of the long hand part 11 and the mounting part 12 of the completed product of the second hand 10 shown in FIG. 1 and the thickness of the short hand part 13 including the weight part 13*a* may be used as the base material 15.

Alternatively, a plate material of aluminum or a thin sheet of another metal can also be used as the base material 15.

Second Embodiment

Next, a second embodiment of the method of manufacturing a hand for an analog electronic timepiece according to the invention will be explained using FIG. 5A to FIG. 5D. This embodiment is the method of manufacturing the second hand 20 shown in FIG. 2.

Figure 5A:
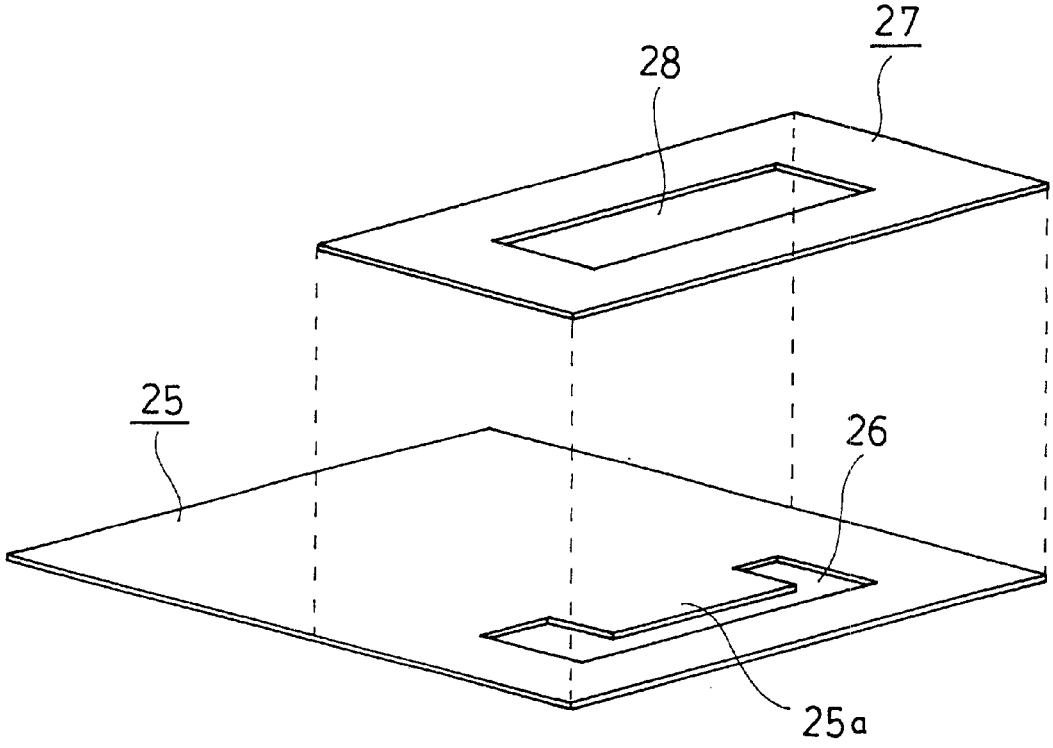
FIG. 5A to FIG. 5D are perspective views showing steps of the second manufacturing method according to the invention.

First, a window 26 is punched out in a thin sheet base material 25 having the same thickness as that of the long hand part 21 and the mounting part 22 of a completed product of the second hand 20 shown in FIG. 2 to surround three sides of a rectangular part 25*a* for forming the weight part of the short hand part 23 of the second hand 20 as shown in FIG. 5A (First step).

Meanwhile, a window 28 is punched out in advance in a plate-shaped piece 27 which is larger in area than the part 25*a* forming the weight part.

Then, the plate-shaped piece 27 is aligned with the base material 25 as shown by broken lines in FIG. 5A to overlap on a region including a part forming the short hand part on the base material 25 except for a part forming the long hand part and the mounting part of the hand and a part 25*a* forming the weight part.

In this example, the plate-shaped piece 27 has the same width as that of the base material 25 and is provided with one window 28 corresponding to the part 25*a* of the base material 25 forming the weight part and the window 26 surrounding the three sides thereof. Accordingly, the plate-shaped piece 27 can be easily aligned with the base material 25 with the width of the plate-shaped piece 27 and the window 28 geometrically coincided with the width of the base material 25 and the window 26. The alignment is possible also by providing pilot holes in the base material 25 and the plate-shaped piece 27 and by inserting pins through the holes.

Figure 5B:
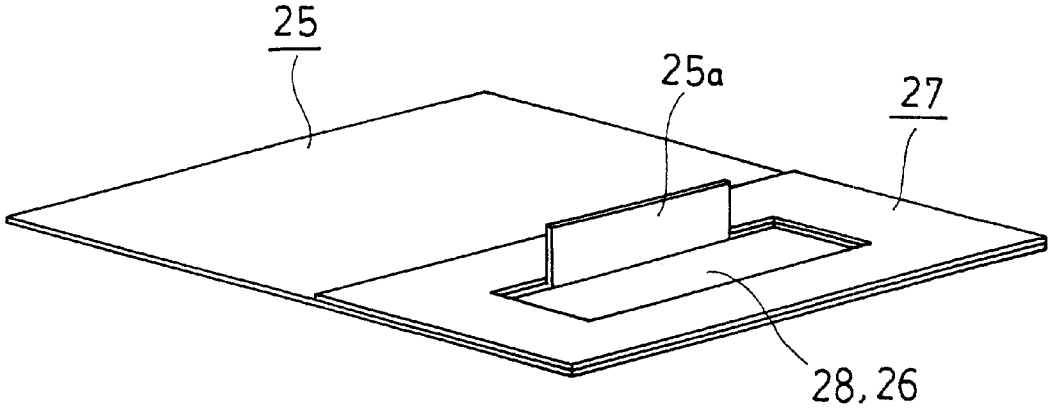
Figure 5C:
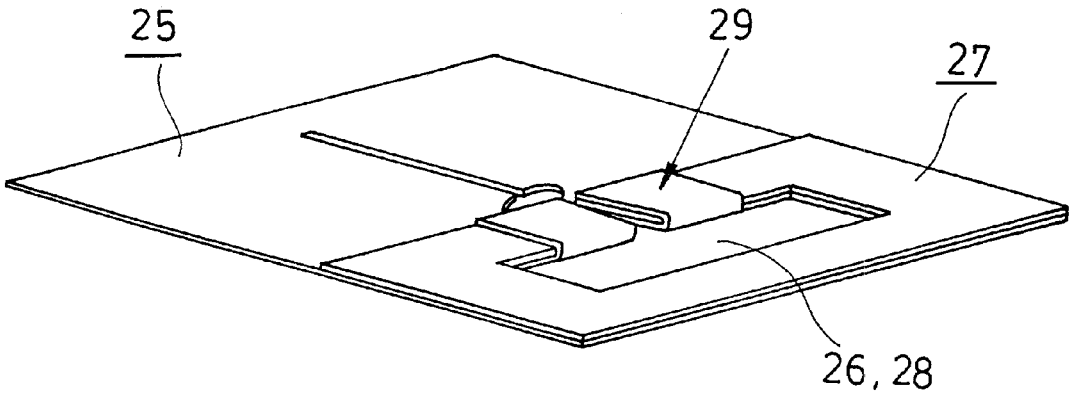

Next, as shown in FIG. 5B, the part 25*a* forming the weight part, of which three sides are surrounded by the window 26, is bent and raised upward at a position of a side of the window 28 formed in the plate-shaped piece 27, and further folded 180° to interpose the plate-shaped piece 27 to thereby form a weighted short hand part forming part 29 shown in FIG. 5C (Second step).

Figure 5D:
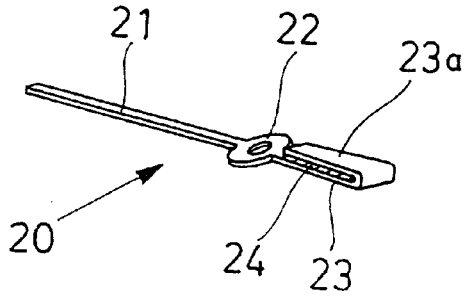

Thereafter, as shown in FIG. 5C and FIG. 5D, the second hand 20 in the final shape is punched out from the base material 25, so that the long hand part 21 and the mounting part 22 are formed with the part forming the long hand part and the mounting part and the short hand part 23 is formed with the weighted short hand part forming part 29, respectively (Third step).

Therefore, the short hand part 23 of the completed second hand 20 shown in FIG. 5D forms the weight part by interposing the weight member 24 (made of the plate-shaped piece 27) by the folded-back part 23*a* (made of the part 25*a* of the base material 25 forming the weight part).

As described above, the second hand 20 can be completed only by press process according to this embodiment.

It should be noted that a plate material of brass with a thickness of 0.13 mm is used as the base material 25, and the long hand part 21 and the mounting part 22 of the second hand 20 are made 0.13 mm in thickness. Further, as the plate-shaped piece 27 which is higher in density than the base material 25 used was a thin sheet member with a thickness of 0.13 mm made of tantalum, which was interposed on the short hand part 23 side to thereby provide the weight part in which the weight member 24 with a high density was interposed between the short hand part 23 and the folded-back part 23*a*. As a result, the moment of the second hand was reduced to 51% of the conventional one.

However, it is also suitable to omit the plate-shaped piece 27 in this embodiment, and to fold the part 25*a* forming the weight part which was formed in the base material 25 in the first step to overlap it directly on the part where the short hand part is formed in the second step to thereby form the weighted short hand part forming part 29 shown in FIG. 5C.

Accordingly, the weight member 24 is not interposed in the short hand part 23 of the second hand 20 completed in the third step, but the mass of the short hand part 23 becomes at least twice that of the conventional one.

Moreover, in the case where the aforesaid plate-shaped piece 27 is used, if a plate material with a density higher than that of the base material 25 is used, a weight part with greater mass can be formed.

For example, it is preferable that a plate material of brass or aluminum is used as the base material 25, and a plate material of tantalum is used as the plate-shaped piece 27.

Furthermore, according to the second manufacturing method, the weight part by folding can be formed with high dimensional accuracy, eliminating variations in moment.

Moreover, it is also possible to carry out the manufacturing method of the second embodiment combined with the aforesaid manufacturing method of the first embodiment.

Third Embodiment

Next, a third embodiment of the method of manufacturing a hand for an analog electronic timepiece according to the invention will be explained using FIG. 6A to FIG. 6C. This embodiment is the method of manufacturing the second hand 30 shown in FIG. 3.

Figure 6A:
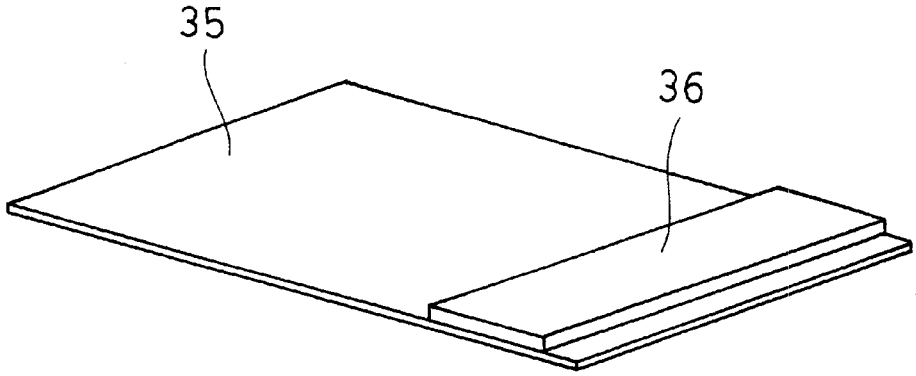
FIG. 6A to FIG. 6C are perspective views showing steps of the third manufacturing method according to the invention.

First, a weight forming member 36 with a density higher than that of the base material is joined, as shown in FIG. 6A, to a part of the surface of a thin sheet base material 35 having the same thickness as that of the long hand part 31 and the mounting part 32 of a completed product of the second hand 30 shown in FIG. 3 (First step).

The weight forming member 36 can be joined to the base material 35 by welding such as spot resistance welding or by spraying or printing.

Figure 6B:
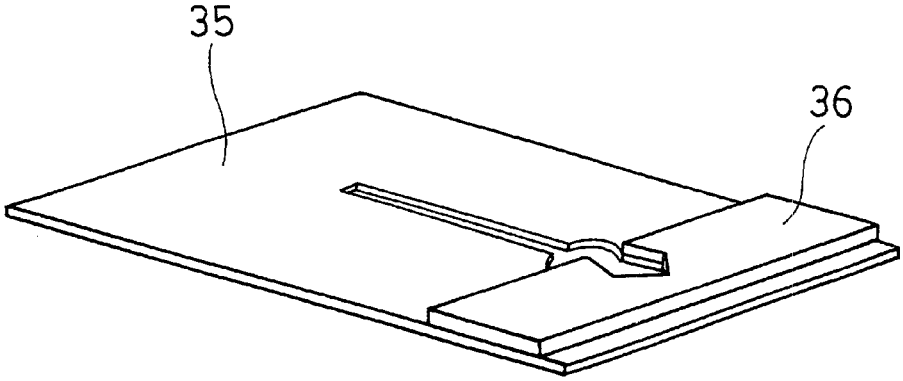
Figure 6C:
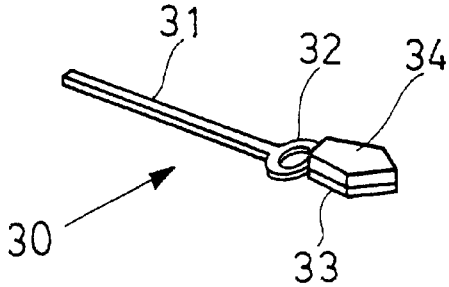
Figure 7:
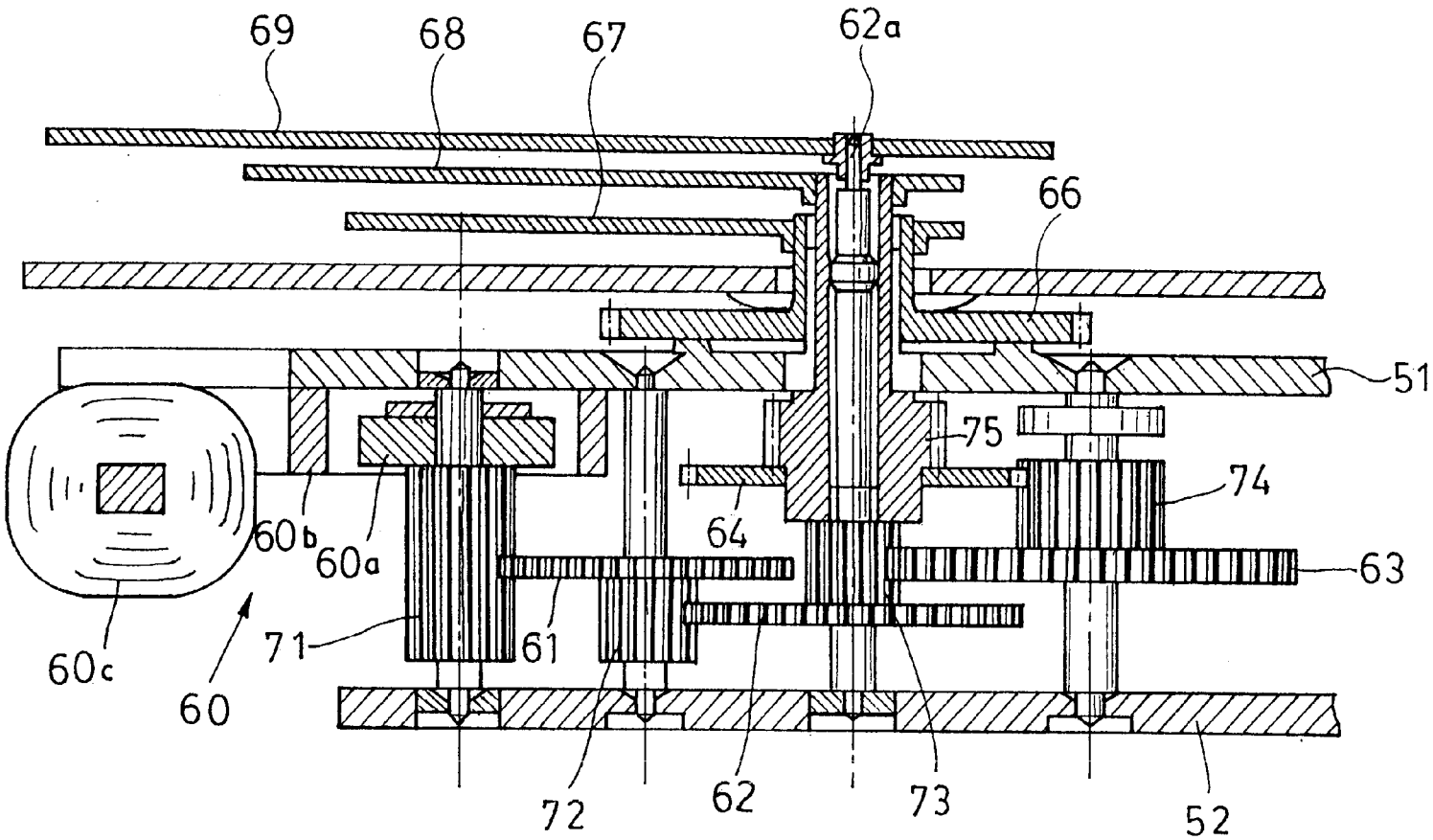
FIG. 7 PRIOR ART
FIG. 7 is a sectional view showing the basic structure of a conventional typical three-hand analog electronic timepiece.

Next, as shown in FIG. 6B and FIG. 6C, the second hand 30 in the final shape is punched out from the base material 35, so that the long hand part 31 and the mounting part 32 are formed with a part to which the weight forming member 36 is not joined and the short hand part 33 is formed with the part to which the weight forming member 36 is joined, respectively (Second step).

Consequently, the second hand 30, in which the weight part 34 made of the weight forming member 36 is added to the short hand part 33, is completed as shown in FIG. 6C.

The second hand which was actually manufactured according to the third embodiment was as follows. The hand was formed into a rectangle in which the length of the long hand part 31 was 11 mm and the width thereof was 0.15 mm and the length of the short hand part 33 was 3 mm and the width thereof was 0.3 mm, and brass with a thickness of 0.13 mm was used for the base material 35. Further, tantalum with a thickness of 0.26 mm was used as a material of the weight forming member 36 with a high density to form the second hand 30 in which the weight part 34 made of a material with a high density was added to the short hand part 33.

Consequently, as for the moment, as compared with the conventional second hand having $8.67\times10^{-9}$ kg·m, the second hand manufactured according to this embodiment has $3.07\times10^{-9}$ kg·m, which is decreased to 36% of that of the conventional one. As for the disturbance energy value of the above decrease, it is found that the disturbance energy value is considerably decreased to be 13% of the value of the conventional one as obtained from the mathematical expression (2).

As for the inertial moment, as compared with the conventional second hand having $6.15\times10^{-11}$ kg·m$^2$, the second hand manufactured according to this embodiment has $7.16\times10^{-11}$ kg·m$^2$, which is increased by about 16% of that of the conventional one. However, the inertial moment of the second hand itself has substantially small influence upon the rotor equivalent inertial moment related to the driving energy, as shown in the mathematical expression (1), and thus an increment here is almost negligible in value.

Both the conventional second hand and the second hand manufactured according to this embodiment were about 600 nJ in actually measured value of input power consumption energy, in which an increase in driving energy was not recognized. Moreover, it was found that the holding properties of the second hand were improved also from the hammer test results.

It should be noted that it is preferable to use a material with a density higher than that of the base material 35 as the weight forming member 36 since sufficient mass can be obtained even if the material is thin in thickness, but the high density is not an essential condition. For example, even in the case where a plate material of the same material as that of the base material 35 is used, if the thickness thereof is the same as that of the base material 35, the short hand part doubles in mass, and if the thickness thereof is twice that of the base material 35, the short hand part triples in mass.

However, it is especially preferable to use a material of brass or aluminum as the base material 35 and to use a tantalum material as the weight forming member 36.

Comparison of Conventional Art and Each Embodiment

Figure 8:
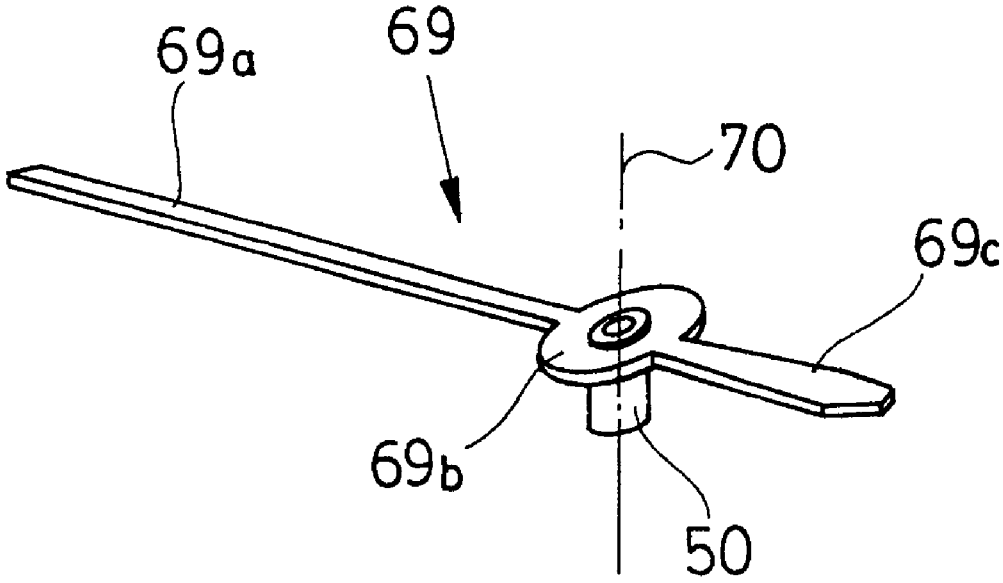
FIG. 8 PRIOR ART
FIG. 8 is a perspective view showing an example of the shape of the second hand of the same.

Here, the moments of the second hands manufactured by the manufacturing methods of the first to third embodiments of the invention as shown in FIG. 1 to FIG. 3 are shown in Table 1 in comparison with the conventional second hand as shown in FIG. 8 with regarding the moment thereof being 100.

In this case, all of the hands were made the same in plane shape and in thickness of the long hand part, and each of the second hands manufactured by the manufacturing methods of the first to the third embodiments of the invention was made such that the thickness of the short hand part including the weight part was three times that of the long hand part.

TABLE 1

| | Moment of second hand |
|---|---|
| Conventional second hand | 100 |
| First embodiment | 67 |
| Second embodiment | 51 |
| Third embodiment | 36 |

As is apparent from Table 1, the moment-reduction effect by the second hand manufactured according to each embodiment of the invention is remarkable, and, also in design of a hand in consideration of decoration, the moment can be made small enough by properly using the first to third embodiments, so that constraints in design are also solved to secure greater flexibility in design.

In each of the aforesaid embodiments, the example in which the second hand in the three-hand analog electronic timepiece is manufactured has been described, but the invention is similarly applicable also to the case in which a minute hand in a two-hand analog electronic timepiece is manufactured.

Industrial Applicability

As is clear from the above, by a method of manufacturing a hand for an analog electronic timepiece according to the invention, a weight part made of the same material as or a material with a density higher than that of a long hand part is added to a short hand part to thereby decrease a value of disturbance energy occurring at the hand upon an external impact to prevent a hand-skip phenomenon even if a holding energy value is made smaller, so that a hand capable of being securely held can be manufactured with ease, reliability, and high dimensional accuracy in the manufacturing process based on a press process, and a danger that the weight part is detached from the hand is also eliminated.

Therefore, it becomes possible to securely hold the hand to thereby prevent occurrence of a hand-skip phenomenon and to provide an analog electronic timepiece with low power consumption at a low cost.

Further, also in design of a hand in consideration of decoration, constraints in design are solved to secure greater flexibility.

What is claimed is:

1. A method of manufacturing a hand for an analog electronic timepiece in which a long hand part for indicating time, a mounting part to be mounted to a hand shaft, and a short hand part, including a weight part, extending to the opposite side of the long hand part with respect to the mounting part are integrally formed, comprising:

a first step of forming a hand in a hand forming part of a thin sheet base material, by forming a thin wall part in said hand forming part, said thin wall part being thinner than said thin sheet base material;

a second step of punching out the hand into a final shape from said base material, such that the long hand part and mounting part are formed from said thin wall part and the short hand part is formed from the base material that is not a part of the thin wall part, wherein said first and second steps are performed in order, and the long hand part and the mounting part are thinner than the short hand part.

2. The method of manufacturing a hand for an analog electronic timepiece according to claim 1, wherein, in said first step, the thin wall part is formed by press working.

3. The method of manufacturing a hand for an analog electronic timepiece according to claim 2, wherein, before said first step, a step of punching out a pair of parallel rectangular windows on both sides of the hand forming part of the base material is performed.

4. The method of manufacturing a hand for an analog electronic timepiece according to claim 1, wherein a plate material of brass or aluminum is used as the base material.

5. A method of manufacturing a hand for an analog electronic timepiece in which a long hand part for indicating time, a mounting part to be mounted to a hand shaft, and a short hand part, including a weight part, extending to the opposite side of the long hand part with respect to the mounting part, are integrally formed, comprising:

a first step of forming a hand in a hand forming part of a thin sheet base material, by forming a thin wall part in said hand forming part, said thin wall part being thinner than said thin sheet base material;

a second step of punching out the hand into a final shape from said base material, such that the long hand part and mounting part are formed from said thin wall part and the short hand part is formed from the base material that is not a part of the thin wall part, wherein said first and second steps are performed in order, and the long hand part and the mounting part are thinner than the short hand part, wherein, in said first step, the thin wall part is formed by press working at the part forming the long hand part and the mounting part of the hand in the hand forming part of the base material, and a thick wall part which is thicker than the original thickness of the base material is formed by coining at the part adjacent to the thin wall part for forming the short hand, respectively, and in said second step, the hand in a final shape is punched out to form the long hand part and the mounting part with the thin wall part of the hand forming part and the short hand part with the thick wall part, respectively.

* * * * *